US006855468B1

(12) United States Patent
Yamamoto et al.

(10) Patent No.: US 6,855,468 B1
(45) Date of Patent: Feb. 15, 2005

(54) COLOR IMAGE FORMATION METHOD

(75) Inventors: Takashi Yamamoto, Kawasaki (JP); Masae Nakamura, Kawasaki (JP); Masakazu Kinoshita, Kato (JP); Yoshimichi Katagiri, Kawasaki (JP); Shin-ichi Kuramoto, Numazu (JP); Hachiro Tosaka, Shizuoka (JP); Hiroshi Yamashita, Numazu (JP); Osamu Uchinokura, Shizuoka (JP)

(73) Assignees: Fujitsu Limited, Kawasaki (JP); Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/712,927

(22) Filed: Nov. 16, 2000

(30) Foreign Application Priority Data

Nov. 19, 1999 (JP) ..... 11-330249

(51) Int. Cl.[7] ..... G03G 15/01
(52) U.S. Cl. ..... 430/45; 430/47
(58) Field of Search ..... 430/108.7, 45, 430/47

(56) References Cited

U.S. PATENT DOCUMENTS 4,395,476 A 7/1983 Kanbe et al.
5,307,127 A 4/1994 Kobayashi et al.
5,698,354 A * 12/1997 Ugai et al. ..... 430/47
6,077,636 A * 6/2000 Moriki et al. ..... 430/45
6,150,062 A * 11/2000 Sugizaki et al. ..... 430/45

FOREIGN PATENT DOCUMENTS

| | | |
|---|---|---|
| JP | 55-18656 | 2/1980 |
| JP | 57-111563 | 7/1982 |
| JP | 06-19297 | 1/1994 |
| JP | 06-59502 | 3/1994 |
| JP | 09-197713 | 7/1997 |

OTHER PUBLICATIONS

Technical Information TI 1222. Special Hydrophobic AEROSIL (SHA) for Toners. Degussa (8/01).*

* cited by examiner

*Primary Examiner*—Christopher Rodee
(74) *Attorney, Agent, or Firm*—Armstrong, Kratz, Quintos, Hanson & Brooks, LLP

(57) ABSTRACT

In a method for forming a multicolored toner image in accordance with an electrophotographic process, the addition amount of external additives to a non-added toner is 1.5 to 10.0 parts by weight per 100 parts by weight of the non-added toner in each developing step, the aggregation degree of the toner is within the range of 30 to 80%, and the change ratio of the aggregation degree satisfies the relation:

$$0.8 \leqq (\text{initial aggregation degree}/\text{aggregation degree after no-load revolution of developing portion for 20 hours}) \leqq 1.2.$$

According to this method, it becomes possible to form a high-quality color image while a toner always keeps a stable degree of aggregation and a charge amount.

10 Claims, 2 Drawing Sheets

COLOR IMAGE FORMATION METHOD

BACKGROUND OF THE INVENTION

1. Field of the Invention

The present invention relates to an image formation method. More particularly, the present invention relates to a method for forming a color image in an electrographic devices such as an electrophotographic copying machine, an electrophotographic printer, and so forth. Among others, the present invention relates particularly to a color image formation method that will be useful for a color image formation system that disposes a plurality of image formation units each for forming a monochromatic image, particularly those image formation units which use a contact type nonmagnetic one-component developing method, in a conveying direction of sheets, and superposes these monochromatic images with one another to form a color image.

2. Description of the Related Art

Various image formation methods are available for forming a color image on an image recording medium such as a sheet of paper, as is well known in the art. An image formation apparatus based on an electrophotographic system employs a method that repeats a process step of forming a toner image of one of the three primary colors (yellow, magenta and cyan) and black for forming a color image on a photosensitive drum and transferring the toner image to the recording sheet, and a method that aligns serially image formation units for forming monochromatic toner images of the three primary colors and black in a sheet conveying direction, superposes the monochromatic images with one another on the recording sheet, and forms the color image (tandem system).

To form a full color image, in particular, a developing machine using a nonmagnetic one-component developer is advantageous from the aspects of the reduction of the size of the developing machine and its cost, high reliability, and so forth. Since the nonmagnetic one-component developer need not use a carrier in combination, means for mixing and agitating the toner is not necessary, transparency is high, and the thickness of the toner film can be reduced. A known developing machine using the one-component developer comprises a developer support for supporting the one-component developer on the surface thereof and carrying the developer along a predetermined circulation route inclusive of a developing region, storage means for storing the one-component developer, and developer feeding means for supplying the one-component developer stored in the developer storing means to the developer support when it comes into contact with the developer support.

The toner used for the prior art image formation apparatus according to an electrophotographic process is generally prepared by dispersing a dye, a pigment, a colorant such as carbon black, into a binder resin made of a natural or synthetic polymer material, and pulverizing and classifying the resulting dispersion to particles having particle diameters of 1 to 30 $\mu$m. To conduct satisfactory printing, the toner has excellent properties such as mechanical properties e.g. particle diameter, shape, degree of aggregation, electric properties such as electric resistance, charge amount, etc, thermal properties such as softening point, melting point, etc, optical properties, safety, storability, and so forth. The toners used for the nonmagnetic one-component developing machine generally contain at least one kind of external additive so as to optimize the property values inclusive of the degree of aggregation and the charge amount and to achieve the formation of a high-quality image. In the case of the non-contact type nonmagnetic one-component developing machine in which development of images is made in accordance with a non-contact or non-impression development method developing the image, for example, the physical attraction force is great between the developing roller as the developer support and the toner and between the toner particles by themselves if the toner having a high degree of aggregation is used. Consequently, the flight range of the toner drops, the image density is low, an intermediate tone cannot be generated and the image has low gradation, as is known to those skilled in the art. Therefore, a nonmagnetic one-component developing machine using the toner, to which an additive (generally called an "external additive") such as silica is added so as to secure fluidity, is known (see, the developing method and apparatus described in Japanese Examined Patent Publication (Kokoku) No. 63-42787, for example). Besides silica, silicon carbide, titanium oxide, etc, are known as the external additive of this kind. A report has been made to the effect that when a toner stipulating the degree of aggregation to 3 to 30% is used, improvement of image quality and prevention of scattering of the toner particles can be achieved simultaneously (see, Japanese Unexamined Patent Publication (Kokai) No. 6-19297, for example). The fluidity of the toner changes during the use of the toner and invites various problems. For example, the image density gradually lowers and the intermediate tone becomes more difficult to obtain. To solve such problems, an image formation method has been reported that decreases the addition amount of the external additive and thus restricts deterioration of fluidity with the passage of time to not greater than 10 in terms of the change amount of the degree of aggregation (see, to the developing machine described in Japanese Unexamined Patent Publication (Kokai) No. 9-197713, for example).

Further, to stabilize the electrostatic charge amount, a method that prevents filming of the toner to the developing roller (see, the electrostatic charge developing toner described in Japanese Unexamined Patent Publication (Kokai) No. 6-59502, for example) and a method that narrows the particle diameter distribution of the toner so as to restrict the fluctuation of the particle diameter distribution of the toner layer on the toner support with consumption of the toner, are known.

In the contact or impression type nonmagnetic one-component developing method in which the developing roller comes into contact with the photosensitive drum as the image support and develops the electrostatic latent image, the toner transfer force created by the electric field generated between the photosensitive drum and the developing roller is stronger than in the developing method in which the photosensitive drum and the developing roller are out of contact from each other. Therefore, even when the toner has relatively low fluidity, image quality is not deteriorated. However, fluidity of the toner must be secured to a certain extent in order to smoothly conduct various processes such as the smooth transfer of the toner inside the developing machine, charging, the formation of the toner layer, and so forth.

Further, there is the problem resulting from the change of fluidity of the toner during the use. That is, there is a problem of a change in the condition of the toner layer formed by a toner layer thickness-limiting blade. The toner layer thickness-limiting blade pushed, at a predetermined pressure, toward the rotating developing roller forms the toner layer on the developing roller. When fluidity of the toner drops, the aggregation force between the toner particles increases. Because the toner cannot be limited to a thin layer, the toner layer thickness becomes larger in this case. Also, the pressure of the toner layer thickness-limiting blade fails to form a uniform toner layer, so that non-uniformity occurs in the toner layer thickness. These changes of the toner with the passage of time invite image defects such as an increase in the printing density, non-uniformity of the density, a drop in reproducibility of the intermediate tone, etc, in the resulting toner image. The problems resulting from the change of the toner with time are more critical in a color image formation apparatus because an actual color image formation apparatus operates in very many cases under a condition where toner consumption does not occur. Color printers, as color image formation apparatuses used in ordinary offices, are mostly used for character printing by using a black toner, and the color toners (yellow, magenta and cyan) are used for only part of the printing. In such an environment, the color toners are kept under the state where their inter-exchange hardly occurs, or does not occur at all. The toners are replaced with the new toners as the toners inside the developing machine are consumed, and deterioration by the stress due to agitation and friction inside the developing machine can be checked up to a certain level. Under the use environment of the color image formation apparatus described above, however, degradation of the toners becomes a serious problem because replacement of the toners does not occur.

Degradation of the toners occurs not only due to the drop of fluidity described above but also due to the drop in the electrostatic charge amount. The drop in the charge amount causes problems such as photographic fog of the base and the occurrence of a negative after-image.

As described above, the fluctuation resulting from degradation of the toners is a serious problem for a color image formation apparatus even when it is a contact type nonmagnetic one-component developing machine. It is therefore very important to keep the toners under the optimum condition in all use environments.

SUMMARY OF THE INVENTION

It is therefore an object of the present invention to provide an image formation method that can solve the problems of the prior art technologies described above, and can form a high-quality color image by keeping the toners always at the stable degree of aggregation and with a stable charge amount.

According to one aspect of the present invention, there is provided a color image formation method which comprises forming an electrostatic latent image in accordance with an electrophotographic process, visualizing the electrostatic latent image by a developer to form a multicolored toner image whereby each monochromatic color toner image is formed by a mutually independent developing step, and superposing then the resulting monochromatic toner images with one another to form a multicolored toner image, characterized by using a toner wherein the addition amount of an external additive to a non-added toner, i.e., toner containing no external additive, is within the range of 1.5 to 10.0 parts by weight on the basis of 100 parts by weight of the non-added toner in each of the developing steps, the degree of aggregation of the toner is within the range of 30 to 80%, and the change ratio of the aggregation degree satisfies the following formula:

$$0.8 \leqq (\text{initial aggregation degree})/(\text{aggregation degree after 20 hours of no-load revolution of developing portion}) \leqq 1.2.$$

According to another aspect of the present invention, there is provided a color image formation method which comprises forming an electrostatic latent image in accordance with an electrophotographic process, visualizing the electrostatic latent image by a developer to form a multicolored color toner image whereby each monochromatic color toner image is formed by a mutually independent developing step, and then superposing the resulting monochromatic toner images with one another to form a multicolored color toner image, characterized by using a toner wherein the addition amount of an external additive to a non-added toner containing no external additive is within the range of 1.5 to 10.0 parts by weight on the basis of 100 parts by weight of the non-added toner in each of the developing steps, and the change ratio of the electrostatic charge amount of the toner on an image support for visualization satisfies the following formula:

$$1.0 \leqq (\text{initial charge amount})/(\text{charge amount after 20 hours of no-load revolution of developing portion}) \leqq 1.5.$$

According to the present invention, in the toner used for the color image formation apparatus, the addition amount of the external additive to the non-added toner is adjusted to 1.5 to 10.0 parts by weight based on 100 parts by weight of the non-added toner. The external additives comprise at least particles having particle diameters of 30 to 100 nm and particles having smaller particle diameters than those of the above particles. The charge amount of at least one kind of the external additives has different polarity from other charge amounts. Thus, the aggregation degree of the toner can be set to 30 to 80%, its change ratio, to 0.8 to 1.2, and the change ratio of the electrostatic charge amount on the toner can be limited to 1.0 to 1.5. Consequently, the change ratio of the aggregation degree of the toner and the change ratio of the electrostatic charge amount can be lowered even under the application condition of physical stress that occurs incessantly, and a satisfactory image can be always provided without deterioration of image quality.

DESCRIPTION OF THE PREFERRED EMBODIMENTS

Figure 1:
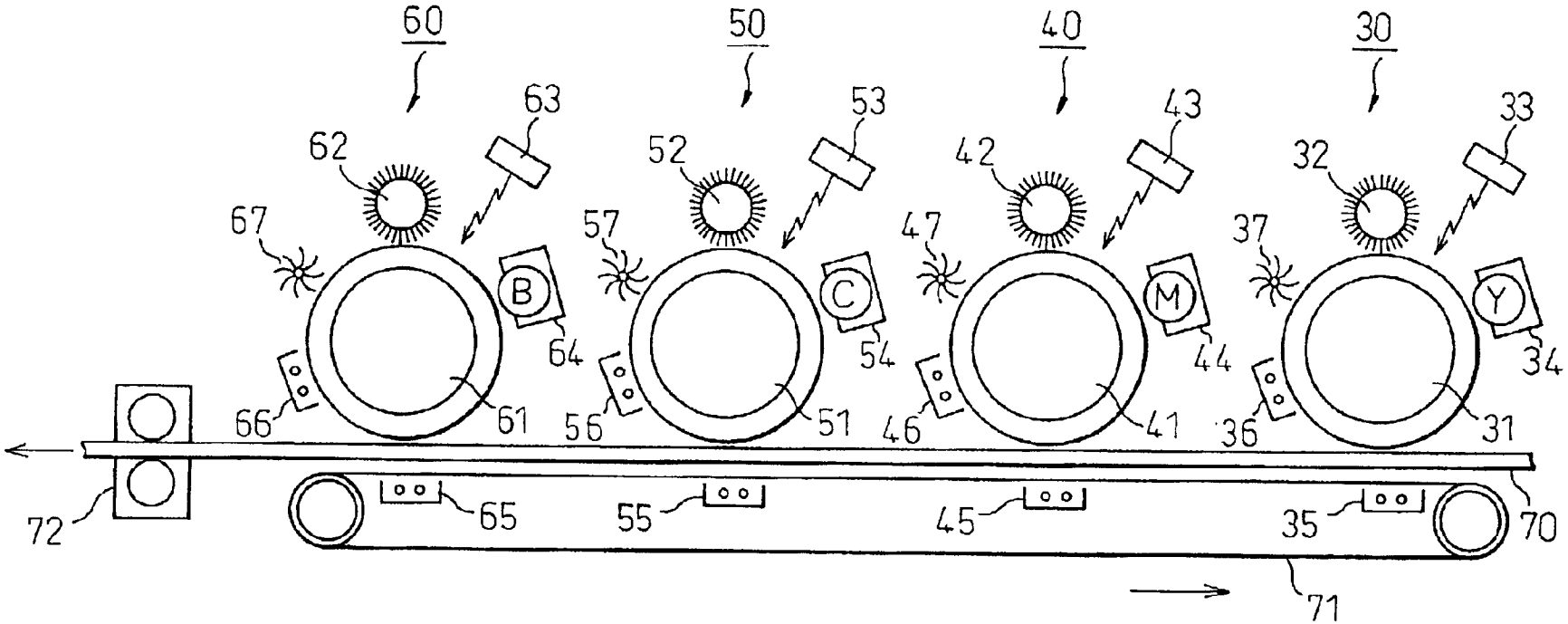
FIG. 1 is a sectional view showing an outline of a tandem type color image formation apparatus useful in the practice of the method of the present invention.

The color image formation method according to the present invention is carried out by forming an electrostatic latent image in accordance with an electrophotographic process, visualizing the electrostatic latent image by a developer to form a multicolored toner image whereby each monochromatic color toner image is formed by a mutually independent developing step, and then superposing the resulting monochromatic toner images with one another to form a multi-color color toner image. As described above, this color image formation method has the following features:

(1) The method uses a toner wherein the addition amount of external additives to a non-added toner is within the range of 1.5 to 10.0 parts by weight on the basis of 100 parts by weight of the non-added toner in each of the developing steps, the aggregation degree of the toner is within the range of 30 to 80%, and the change ratio of the aggregation degree satisfies the following formula:

$$0.8 \leqq (\text{initial aggregation degree})/(\text{aggregation degree after 20 hours of no-load revolution of developing portion}) \leqq 1.2; \text{ and}$$

(2) The method uses a toner wherein the addition amount of an external additive to a non-added toner is within the range of 1.5 to 10.0 parts by weight on the basis of 100 parts by weight of the non-added toner in each of the developing steps, and the change ratio of the electrostatic charge amount of the toner on an image support for visualization satisfies the following formula:

$$1.0 \leqq (\text{initial charge amount})/(\text{charge amount after 20 hours of no-load revolution of developing portion}) \leqq 1.5.$$

The color image formation method according to the present invention is particularly useful for a color image formation apparatus such as electrophotographic color copying machines, electrophotographic color printers, and so forth. Such an image formation process generally forms monochromatic toner images of yellow, magenta, cyan and black by a series of following steps:

(1) charging step for imparting photosensitivity to an image support (electrostatic recording medium);

(2) exposing step (latent image formation step) of applying image formation exposure to the image support, and forming and recording an electrostatic latent image;

(3) developing step of causing the electrostatic latent image recorded on the image support to electrically attract a developer (toner), and physically visualizing the electrostatic latent image;

(4) transferring step of transferring serially the visualized toner image on the image support to the recording medium such as a recording sheet, and superposing the visualized toner images with one another; and (5) image fixing step of heating and fixing the transferred image on the recording medium.

The first step of the color image formation method, i.e., charging step begins with the preparation of an image support. The image support is a constituent element as the basis of an image formation apparatus. It is typically a photosensitive drum. The photosensitive drum can be produced by using an aluminum drum as a core metal, for example, mirror-finishing the surface and depositing further a layer of a photosensitive material on the surface. Selenium, zinc oxide, cadmium sulfide, organic photoconductors (OPC) or amorphous silicon can be used as the photosensitive material. Vacuum deposition or coating can be employed for applying the photosensitive material.

A corona charging device or a conductive brush charging device can be used as the charging device for uniformly charging the image support. Unlike the corona charger, the conductive brush charging device is free from the problem of the occurrence of ozone, and can be used advantageously in the practice of the present invention. More particularly, the conductive brush charging device can charge the image support to a necessary potential when it applies a voltage of 500 volts to 1.5 kV to a conductive brush. The conductive brush may have the construction in which a conductive fiber (rayon fiber or polyester fiber, for example) implanted in a base fabric is wound round a conductive core rod to form a rotary conductive roller, or the construction in which conductive fibers are bundled and fixed in the shape of a brush to form a sheet-like (bar-like) brush. In the latter case, the size and the cost can be much lower than in the former.

Subsequently, imagewise exposure is applied to the electrostatically charged image support to form and record an electrostatic latent image. Various exposure methods can be employed for this exposure step depending upon the latent image formation step employed. Generally, a semiconductor laser optical system, an LED optical system, a liquid crystal shutter (LCS) optical system, or the like, can be used as an exposure source.

After the exposing step is completed, the developing step for causing the electrostatic latent image recorded on the image support to electrically attract the developer, and visualizing physically the electrostatic latent image is conducted. This step, too, can be conducted by using various devices and apparatuses in the same way as other steps of the method of the present invention. Typically, the developing machine comprises the following constituent members, through various changes or modifications may occur depending on the developing system employed:

a toner container (toner hopper, where the developer, preferably nonmagnetic one-component developer, is stored) defined by a casing;

image support (afore-mentioned) capable of forming the electrostatic latent image and holding it;

a developer support capable of transporting the developer to a developing region on the image support and so disposed as to oppose and come into contact with the image support;

a developer feeding member capable of supplying the developer inside the toner container to the developer support, and disposed movably while keeping flexible contact with the developer support; and a thickness-limiting member for limiting the thickness of the developer on the developer support supplied from the developer feeding member.

The developer support capable of transporting the developer to the developing region on the image support such as the photosensitive drum and so disposed as to oppose the image support while keeping contact with the image support is preferably made of a conductor, and is typically a developing roller or a developing sleeve. To produce the developing roller, an aluminum roller, for example, is used as a core metal, and the surface of the roller is coated with a resin coating. Fiber brushes may be implanted to the roller surface, whenever necessary.

The developer feeding member capable of supplying the developer inside the toner container to the developer support and so disposed as to be capable of moving while keeping flexible contact with the developer support is preferably made of a conductor, and is typically a sponge roller or a fur brush. To produce the sponge roller, for example, an aluminum roller is used as the core metal and a porous resin coating is applied to its surface, or substantially the whole portion of the roller is formed from a sponge material, having flexibility, such as a urethane foam.

The thickness-limiting member used for limiting the thickness of the developer supplied from the developer feeding member to the developer support is typically a thickness-limiting blade. The thickness-limiting blade can be shaped from various elastic materials into different shapes in order to control the thickness of the developer caused to adhere to the developer support in a film. Examples of the material of the thickness-limiting blade are an elastic rubber, a stainless steel sheet and a leaf spring. These materials are processed into a shape capable of easily scraping off the toner such as a tongue shape or a spatula shape.

In addition to the typical constituent elements described above, the developing machine used for executing the method of the present invention may further include a toner agitation mechanism, a toner density control mechanism, a toner supplementation mechanism, a developing bias control mechanism, and so forth. Since these mechanisms are well known to those skilled in the art, explanations will be omitted.

Figure 2:
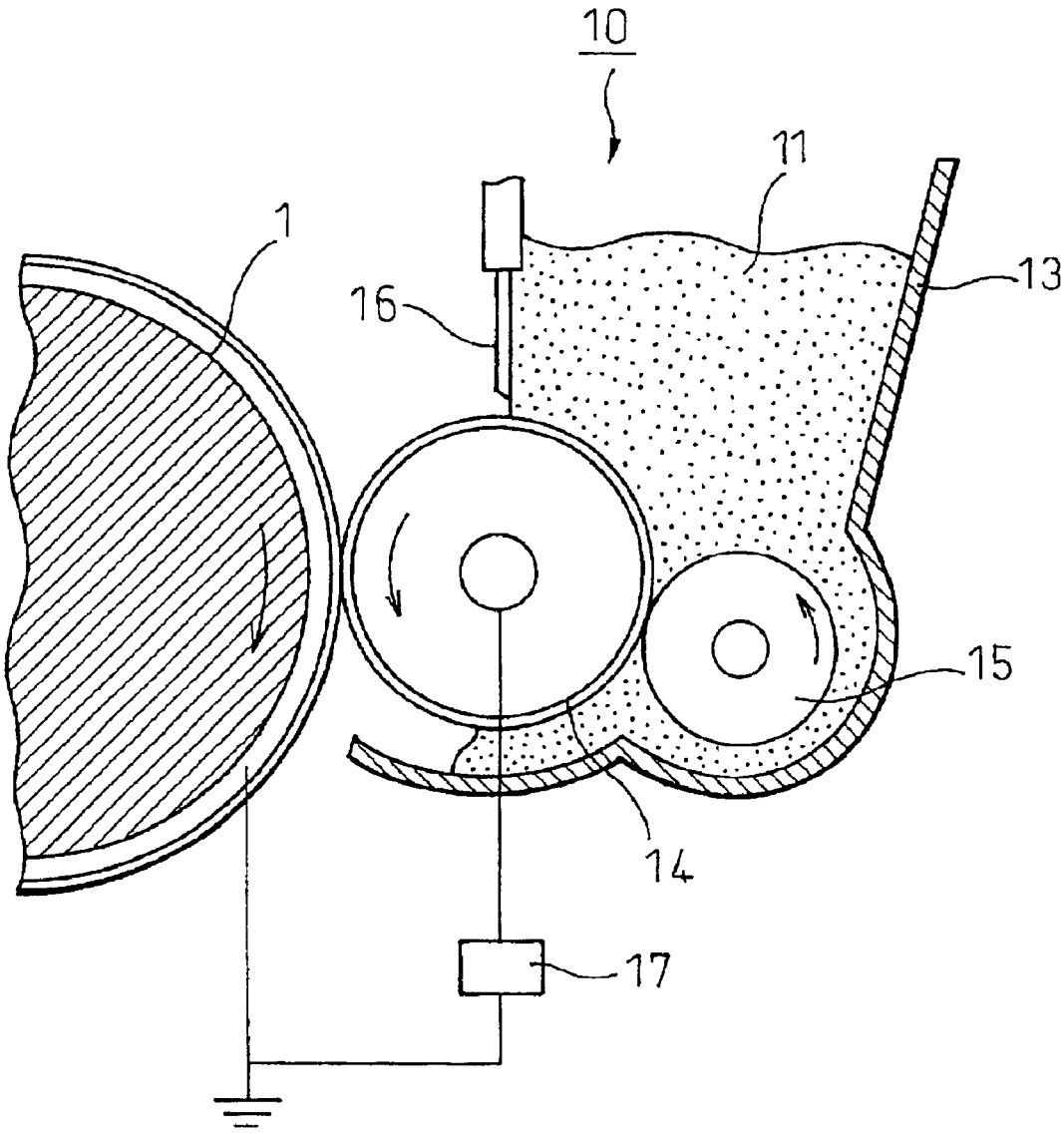
FIG. 2 is a sectional view showing an outline of a contact type nonmagnetic one-component developing machine that can be used in the practice of the method of the present invention.

The explanation of the present invention will continue. FIG. 2 is a schematic structural view of a contact type nonmagnetic one-component developing machine that can be used advantageously in the practice of the present invention, that is, for the color image formation apparatus according to the present invention. The developing machine 10 has a toner container 13 for storing a nonmagnetic one-component developer comprising solely a toner not containing a magnetic substance, that is, a nonmagnetic toner 11. The toner container 13 contains therein a developing roller 14 as a developer support, a toner supplementation roll (sponge roller) 15 as a developer feeding member, and a toner layer thickness-limiting blade 16 as a thickness-limiting member.

The nonmagnetic toner 11 will be described later. The developing roller 14 is disposed at the opening of the toner container 13 in such a manner as to oppose a photosensitive drum 1 while keeping contact with the photosensitive drum 1. The developing roller 14 moves at the opposed portion to the photosensitive drum 1 in the same direction as the photosensitive drum 1, and conveys the toner 11 supported on the developing roller 14 towards the photosensitive drum 1. A suitable developing bias voltage such as DC, AC, AC superposed with DC or a pulse voltage is applied by a bias voltage source 17 to the developing roller 14.

The sponge roller 15 keeps flexible contact with the developing roller 14 on the opposite side to the photosensitive drum 1, rotates (counter-rotation) in the opposite direction at the contact portion with the developing roller 14, scrapes off the remaining toner on the developing roller 14 after development and simultaneously supplies the new toner 11 inside the toner container 13 to the developing roller 14. The toner 11 supplied afresh undergoes friction between the developing roller 14 and the sponge roller 15, acquires a charge due to the friction, adheres to the developing roller 14 by its image force, and is conveyed. On the other hand, the mechanical force of friction between the developing roller 14 and the nip of the sponge roller 15 scrapes off the remaining toner after development. In this way, the sponge roller 15 scrapes off the remaining toner after development and simultaneously executes charging and supply of the new toner. The toner layer thickness-limiting blade 16 is fitted to the toner container 13 above the developing roller 14 and is brought into counter-contact with the peripheral surface of the developing roller 14 in such a manner as to rotate in the direction opposite to the rotating direction of the developing roller 14. The toner layer thickness-limiting blade 16 frictionally charges the toner 11 during the transfer of the toner 11 towards the photosensitive drum 1. Consequently, the toner acquires the frictional charge. To effectively achieve this frictional charge, a member charged to the opposite polarity to that of the toner 11 is sometimes disposed on the contact surface of the toner layer thickness-limiting blade 16 with the developing roller 14. The toner 11 conveyed to the developing region is used for developing the electrostatic latent image formed on the photosensitive drum 1, and a visualized toner image can be thus obtained.

After the electrostatic latent image on the image support is visualized to form the toner image, the toner image is electrostatically transferred to a recording medium such as a recording sheet, and is recorded. Examples of the electrostatic transfer method include a corona transfer method, a roller transfer method and a belt transfer method. The method of the present invention can advantageously conduct this transfer process by serially superposing the monochromatic toner images of yellow, magenta, cyan and black on the recording medium.

Subsequently, the toner images transferred and superposed on the recording medium are heated and fixed. Various heating means can be employed to execute this image fixing process. Examples of the suitable fixing method include a heat roll fixing method, a flash fixing method and an oven fixing method.

In addition to the various means and devices described above, well-known means and devices necessary for executing the electrophotographic process such as a cleaning device, a de-charging device, etc, can be used in order to conduct the image formation method of the present invention. Since these means and devices are well known to those skilled in the art, detailed explanations will be omitted.

The color image formation method according to the present invention can be carried out by using various image formation apparatuses within the scope of the present invention, but can be preferably carried out by using the tandem system color image formation apparatus. The preferred tandem system color image formation apparatus will be explained below with reference to FIG. 1.

FIG. 1 is a sectional view typically showing a preferred example of the tandem system (4-drum system) color image formation apparatus equipped with the developing machine having the construction described above on the basis of the electrophotographic system. As shown in the drawing, image formation units 30, 40, 50 and 60 for forming yellow, magenta, cyan and black monochromatic images, respectively, are arranged in the conveying direction of a recording sheet 70 (represented by an arrow). Each image formation unit comprises a charging device for applying charge to the surface of a photosensitive drum, an exposing device for forming a latent image, a developing device for visualizing the latent image by using a developer and forming a toner image, a transferring device for transferring the visualized toner image to a sheet as an image recording medium, a de-charging device for removing the residual charge on the surface of the photosensitive drum from the photosensitive drum, and a cleaning device for removing the residual transfer toner remaining on the photosensitive drum after the transfer of the toner image, with the photosensitive drum as the image support being at the center. The yellow image formation unit 30, for example, comprises a conductive belt charger 32, an exposing device 33, a developing device 34, an image-transferring device 35, a de-charging device 36 and a cleaning device 37. The magenta image formation unit 40, the cyan image formation unit 50 and the black image formation unit 60, too, have constructions similar to the construction of the yellow image formation unit 30. A transfer belt 71 is a semi-conductive dielectric belt that can move in the direction indicated by arrow, and can electrostatically adsorb and convey the sheet 70. The toner image comprising yellow, magenta, cyan and black is fused and fixed to the sheet 70 by an image fixing device 72, giving an intended full-color color image.

The inventors of the present invention prepared a nonmagnetic toner having little fluctuation of toner fluidity and charge amount, and examined their change amounts by mounting the contact type nonmagnetic one-component developing machine shown in FIG. 2 to the color image formation apparatus shown in FIG. 1. The operation of the apparatus was as follows.

A voltage was applied to the toner supplementation roll (sponge roller) 15 and to the developing roller 14 of the developing machine 10. While each driving portion of the image formation apparatus was operated, the continuous operation was conducted for at least 20 hours. The image formation apparatus used herein can print 13 color image sheets per minute, and thus the time necessary for printing 15,000 sheets is about 20 hours. In this experiment, the operation was conducted under the conditions where the electrostatic latent image is not imparted deliberately to the photosensitive drum, that is, at a printing ratio of 0%, in order to prevent consumption and to prevent inter-exchange of the toner. The printing condition is also referred to as "non-loading". As a result of examination, it has been confirmed that no degradation occurs in the toner.

The above examination method represents an embodiment so as to impart the stress to the toner, and thus is not restrictive. For example, it is possible to employ a method that imparts the agitation stress to the toner by using an agitator under the state where the exchange of the toner does not exist, and the method is not particularly limited so long as it can compare the degrees of degradation of the toner.

In the method of the present invention, the developer used for visualizing the electrostatic latent image is preferably a nonmagnetic one-component developer. The inventors of the present invention have found that when such a specific developer is used, the function and effects peculiar to the present invention can be exhibited fully. Since the nonmagnetic one-component developer does not require the use of the carrier in combination, means for mixing and agitating the toner becomes unnecessary, and the scale of the developing device can be reduced. This developer does not require mixing of a magnetic material with the toner, has high transparency and can form a thin film of the toner. Therefore, its effects can be used for forming the full-color image. This one-component developer may have basically the same composition as that of the conventional one-component developers with the exception that the condition of the external additives is specifically stipulated in the present invention. Therefore, this one-component developer may be prepared in the same way as the conventional one-component developers.

The binder resin as the principal component of this one-component developer (hereinafter called also the "developer" or the "toner") includes various resin materials. Suitable examples of the binder resin are as follows, though they are not particularly restrictive: polyol resins; polymers of styrene and its substitution products such as polystyrene, poly-p-chlorostyrene and polyvinyltoluene; styrene type copolymers such as styrene-p-chlorostyrene copolymer, styrene-propylene copolymer, styrene-vinyltoluene copolymer, styrene-vinylnaphthalene copolymer, styrene-acrylic acid copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chloromethacrylate, styrene-acrylonitrile copolymer, styrene-vinylethyl ether copolymer, styrene-vinylmethyl ketone copolymer, styrene-butadiene copolymer, styrene-isoprene copolymer, styrene-acrylonitrile-indene copolymer, styrene-maleic acid copolymer, styrene-maleic acid ester copolymer, etc; polymethyl methacrylate, polybutyl methacrylate, polyvinyl chloride, polyvinyl acetate, polyethylene, polypropylene, polyester, epoxy resin, epoxypolyol resin, polyurethane, polyamide, polyvinyl butyral, polyacrylic acid resin, rosins, modified rosins, terpene resin, phenol resin, fatty or alicyclic hydrocarbon resin, aromatic petroleum resin, chlorinated paraffin, and paraffin wax. These binder resins may be used either alone or in mixture of two or more kinds.

Colorants can be also used as the developer component. Known dyes and pigments that are generally used for the developer can be all used. Examples of suitable colorants include carbon black, Nigrosine dyes, iron black, Naphthol Yellow S, Hansa Yellow (10G, 5G, G), cadmium yellow, yellow iron oxide, chinese yellow, chrome yellow, titanium yellow, polyazo yellow, oil yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, Anthrazine Yellow BGL, Isoindolinone Yellow, iron oxide red, minium, red lead, cadmium red, cadmium mercury red, antimony red, Permanent Red 4R, Para Red, Phiser Red, parachloro-orthonitroaniline red, Resol Fast Scarlet G, Brilliant Fast Scarlet, Brilliant Carmine BS, Permanent Red (F2R, F4R, FRL, FRLL, F4RH), Fast Scarlet VD, Vulcan Fast Rubin B, Brilliant Scarlet G, Resol Rubin GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosine Lake, Rhodamine Lake B, Rhodamine Lake Y, Alizaline Lake, Thioindigo Red B, Thioindigo Maroon, Oil Red, Quinacridone Red, Pyrazolone Red, Polyazo Red, Chrome vermilion, Benzidine Orange, Perynone Orange, Oil Orange, Cobalt Blue, cerulean blue, Alkali Blue Lake, Peacock Blue Lake, Victoria Blue Lake, non-metallic Phthalocyanine Blue, Phthalocyanine Blue, Fast Sky Blue, Indanthrene Blue (RS, BC), Indigo, Ultramarine, Berlin Blue, Anthraquinone Blue, Fast Violet B, Methyl Violet Lake, cobalt violet, manganese violet, Dioxane Violet, Anthraquinone Violet, Chrome Green, Zinc Green, chromium oxide, pyridian, Emerald Green, Pigment Green B, Naphthol Green B, Green Gold, Acid Green Lake, Malachite Green Lake, Phthalocyanine Green, Anthraquinone Green, titanium oxide, zinc white, lithopone, and so forth. These colorants may be used either alone or in mixture of two or more kinds. The amount of the colorants used can be changed over a broad range depending on the kind of the developer to which the colorants are added, and on the desired effects. Generally, however, the amount of the colorants is 0.1 to 50 parts by weight on the basis of 100 parts by weight of the binder resin.

In the practice of the method of the present invention, a plurality of colors of toners for forming the color image may be arbitrary, but they can preferably reproduce full color images. When the plurality of colors other than black is yellow, cyan and magenta, the number of times of the development operations is small, and they can cover a relatively broad color tone range.

The developer used in the present invention may contain a charge controller, if necessary. A known charge controller used for the developer can be used. Examples of suitable charge controllers are as follows, though they are not restrictive: nigrosine type dyes, triphenylmethane type dyes, Cr-containing metal complex dyes, molybdic acid chelate pigments, Rhodamine type dyes, alkoxy type amines, quaternary ammonium salts (including fluorine-modified quaternary ammonium salts), alkylamides, single substance or compounds of phosphorus, single substance or compounds of tungsten, fluorine type active agents, metal salicylates, and metal salts of salicylic acid derivatives.

The explanation will be given more concretely. Examples of such charge controllers include a nigrosine dye "Bontron 03", a quaternary ammonium salt "Bontron P-51", a metal-containing azo dye "Bontron S-34", an oxynaphthoeic acid type metal complex "E-82", a salicylic acid type metal complex "E-84", and a phenolic condensate "E-89" (all being the products of Orient Chemical Industry Co.), a quaternary ammonium salt molybdenum complex "TP-302" and "TP-415" (products of Hodogaya Chemical Industry Co.), a quaternary ammonium salt "Copy Charge SPY VP2038", a triphenylmethane derivative "Copy Blue PR", a quaternary ammonium salt "Copy Charge NEG VP2036" or "Copy Charge NX VP434" (products of Hoechst Co.), iodine complexes "LRA-901" and "LR-147" (products of Nihon Carlit Co.), copper phthalocyanine pigments, perilene pigments, quinacridone pigments, azo type pigments and other polymeric compounds having functional groups such as a sulfonic acid group, a carboxyl group, a quaternary ammonium salt, and so forth. These charge controllers may be used either alone or in a mixture of two or more kinds.

The amount of the charge controller used in the developer is determined by the kind of the binder resin, the existence/absence of the additive(s) used whenever necessary, and the toner production method inclusive of the dispersion method, and is not primarily limited. However, it is preferably within the range of 0.1 to 10 parts by weight on the basis of 100 parts by weight of the binder resin. The amount of the charge controller is further preferably within the range of 2 to 5 parts by weight. When the amount of use of the charge controller is less than 0.1 parts by weight, the negative charge of the toner becomes practically insufficient. When it exceeds 10 parts by weight, on the other hand, the charge property of the charge controller becomes so great that the drop of the image density occurs due to so-called "spent" or filming of toner that results from the increase of the electrostatic attraction force with the developing roller, etc.

In order to give a mold releasability to the developer, the developer used in the present invention preferably contains a wax. The wax suitable for imparting mold releasability has a melting point within the range of 40 to 120° C., and preferably within the range of 50 to 110° C. When the melting point of the wax is excessively high, offset resistance and durability drop in some cases. When the melting point is excessively low, on the other hand, durability is likely to drop. The melting point of the wax can be determined by differential scanning thermal analysis (DSC). In other words, several milligrams of the sample is heated at a predetermined temperature elevation rate such as 10° C./min, and the melting peak value at this time is used as the melting point.

Examples of the waxes that can be used for the developer of the present invention, though they are in no way restrictive, include solid paraffin wax, micro-wax, rice wax, fatty acid amide type wax, fatty acid type wax, fatty acid mono-ketones, fatty acid metal salt wax, fatty acid ester type wax, partial saponified fatty acid ester type wax, silicone varnish, higher alcohols, carnauba wax, and so forth. Polyolefins such as low molecular weight polyethylene, polypropylene, etc, can also be used as the wax. Polyolefin waxes having a softening point within the range of 70 to 150° C., as measured by the ring-and-ball method, particularly preferably polyolefin waxes having a softening point within the range of 120 to 150° C. are used for the developer. These waxes may be used either alone or in mixture of two or more kinds.

The developer used in the present invention can be prepared by mixing the constituent materials described above by a conventional production method. Black toner and a plurality of toners can be produced preferably by mixing the constituent materials described above by a mixer such as a Henschel mixer, heat-kneading the mixture by a kneading machine such as a continuous kneader or a roll kneader, cooling and solidifying the kneaded product, and pulverizing and classifying the solid product to obtain a desired particle size distribution. Other preparation methods include a spray drying method, a polymerization method and a micro-capsulation method. The toner so obtained is sufficiently mixed with suitable external additives by using the Henschel mixer, for example, to obtain finally the intended toner.

It is essentially necessary in the developer used for the present invention that the external additives capable of satisfying the specific condition described above are added further to the toner prepared in the manner described above. The external additives used for this purpose may be basically the customary external additives conventionally used in the field of electrophotography. Suitable external additives, for example, include inorganic fine particles. The primary particle diameter of the inorganic fine particles used as the external additives is generally, and preferably, 0.005 to 2 $\mu$m, particularly preferably 0.005 to 0.5 $\mu$m. The specific surface area of such inorganic fine particles is preferably within the range of 20 to 500 $m^2/g$ as measured by the BET method. The proportion of the use of such inorganic fine particles is preferably within the range of 0.01 to 5.0 wt % on the basis of the total amount of the toner, more preferably within the range of 0.01 to 2.0 wt %. Concrete examples of suitable inorganic fine particles are silica, alumina, titanium oxide, barium titanate, magnesium titanate, calcium titanate, strontium titanate, zinc oxide, tin oxide, silica sand, clay, mica, diatomaceous earth, chromium oxide, cerium oxide, iron oxide red, antimony trioxide, magnesium oxide, zirconium oxide, barium sulfate, barium carbonate, calcium carbonate, silica carbide and silicon nitride.

Besides the inorganic fine particles described above, suitable external additives include polymeric fine particles such as fine particles of polymer such as polystyrene, methacrylic acid esters and acrylic acid ester copolymers that are obtained by soap-free emulsion polymerization or dispersion polymerization, fine particles of polycondensates such as silicone, benzoguanamine, nylon, etc, and polymeric particles of thermo-setting resins.

It is useful to add further a fluidizing agent or a surfactant to the external additives described above. Such a surface-treating agent executes surface treatment of the toner, improves its hydrophobicity and can prevent deterioration of fluidization characteristics and charging properties even at high moisture. Examples of such surface treating agents are a silane coupling agent, a silylation agent, a silane coupling agent having a fluorinated alkyl group, an organotitanate type coupling agent and an aluminum type coupling agent.

A cleaning property improving agent is also useful as one of the external additives. The cleaning property improving agent has the function of removing the developer remaining on the photosensitive drum and on the primary transfer medium after transfer, that is, the function of improving the cleaning property. Suitable examples of such a cleaning property improving agent include fatty acid metal salts such as zinc stearate, calcium stearate and sodium stearate, and polymer fine particles obtained by soap-free emulsion polymerization such as polymethyl methacrylate fine particles and polystyrene fine particles. The polymer fine particles used herein as the cleaning property improving agent have a relatively narrow particle diameter distribution, and have preferably a volume mean particle diameter falling within the range of 0.01 to 1 $\mu$m.

In addition, the mean particle diameter of the toner and its particle size distribution can be measured by various customary methods. For example, the mean particle diameter of the toner and its particle size distribution can be measured by using "Coultar Counter TA-II" or "Coultar Multisizer" (products of Coultar Co.). It is also possible to use "ISOTON-II" (a product of Coultar Scientific Japan Co.), though the present invention does not use it.

EXAMPLES

The image formation method of the present invention will be explained in further detail with reference to Examples thereof. It is to be noted, however, that the present invention is not limited to these Examples.

Example 1

Preparation of nonmagnetic toner having low toner fluidity and little fluctuation of charge amount:

| (1) Preparation of toner A: | |
|---|---|
| binder resin: polyester resin (acid value = 5, Mn = 4,500, Mw/Mn = 4.0, Tg = 60° C.) | 100 parts by weight |
| charge controller: zinc salicylate derivative | 4 parts by weight |
| colorant: copper phthalocyanine blue pigment (C. I. PIGMENT BLUE 15) | 4 parts by weight |

The mixture of the composition described above was melt-kneaded by using a roll mill and was cooled. The resulting mixture was coarsely pulverized by using a hammer mill and was further pulverized finely by using a jet mill. The resulting fine powder was classified to obtain powder having a volume mean particle diameter of 8.5 μm. This powder is referred to as "toner A".

(2) Preparation of Toner B:

100 parts by weight of the toner A prepared as described above and 0.01 part of hydrophobic silica (mean particle diameter of primary particles=approx. 16 nm, trade name "R972D", a product of Nippon Aerosil Co.) were mixed by using a high-speed rotary mixer to prepare a toner B.

(3) Preparation of Toner C:

100 parts by weight of the toner A prepared as described above and 0.5 parts by weight of hydrophobic silica (mean particle diameter of primary particles=approx. 16 nm, trade name "R972D", a product of Nippon Aerosil Co.) were mixed by using a high-speed rotary mixer to prepare a toner C.

(4) Preparation of Toner D:

100. parts by weight of the toner A prepared as described above, 0.2 parts by weight of hydrophobic silica (mean particle diameter of primary particles=approx. 10 nm, trade name "HDK H200", Clariant Japan Co.) and 1.5 parts by weight of hydrophobic silica having a negative charge polarity (mean particle diameter of primary particles=approx. 40 nm, trade name "RX-50", Nippon Aerosil Co.) were mixed by using a high-speed rotary mixer to prepare a toner D.

(5) Preparation of Toner E:

100 parts by weight of the toner A prepared as described above, 0.2 parts by weight of hydrophobic silica having a negative charge polarity (mean particle diameter of primary particles=approx. 7 nm, trade name "R8112", Nippon Aerosil Co.), 2.5 parts by weight of hydrophobic silica having a negative charge polarity (mean particle diameter of primary particles=approx. 30 nm, trade name "NY-50", Nippon Aerosil Co.) and 0.5 parts by weight of positive polarity particles (trade name "Epostar S-6". Nippon Shokubai K. K.) were mixed by using a high-speed rotary mixer to prepare a toner E.

(6) Preparation of Toner F:

100 parts by weight of a non-added toner prepared by changing the condition for pulverizing and classifying in the kneading step of the "Preparation of toner A" in the above item (1) and having a volume mean particle diameter of 6.9 μm, 0.8 parts by weight of hydrophobic silica (mean particle diameter of primary particles=approx. 16 nm, trade name "R972D", Nippon Aerosil Co.), 2.4 parts by weight of hydrophobic silica having a negative charge polarity (mean particle diameter of primary particles=approx. 40 nm, trade name "RX-50", Nippon Aerosil Co.) and 0.4 parts by weight of positive polarity particles (trade name "P-2000", Nippon Paint Co.) were mixed by using a high-speed rotary mixer to prepare a toner F.

(7) Preparation of Toner G:

A toner G was prepared in the same way as the preparation of the toner A. In this example, however, the condition of pulverizing and classifying the cooled kneaded product was changed to prepare a non-added toner having a volume mean particle diameter of 11.5 μm. 100 parts by weight of this non-added toner, 0.1 parts by weight of hydrophobic silica having a negative charge polarity (mean particle diameter of primary particles=approx. 7 nm, trade name "R-812, Nippon Aerosil Co.) and 8.0 parts by weight of fine powder prepared by adding dimethylpolysiloxane to titanium oxide having a mean particle diameter of 70 nm were mixed by using a high-speed rotary mixer to prepare a toner G.

(8) Preparation of Toner H:

100 parts by weight of the toner A prepared as described above, 2.0 parts by weight of hydrophobic silica having a negative charge polarity (mean particle diameter of primary particles=approx. 40 nm, trade name "RY-50", Nippon Aerosil Co.) and 0.8 parts by weight of positive polarity particles (trade name "P-2000, Nippon Paint Co.) were mixed by using a high-speed rotary mixer to prepare a toner H.

Example 2

Evaluation Test of Toners:

The change ratio of the aggregation degree and the change ratio of the electrostatic charge amount were measured for each of the toners A to H prepared as described above in the initial stage and after the continuous operation. At the same time, the quality of the printed images was compared and examined. To conduct this evaluation test, each toner inside the toner container that did not receive the stress was collected as the initial toner. Each toner on the back of the developing roller, where the toner was believed to be most likely to receive the stress inside the toner container, was collected as the toner after the continuous operation.

[Measurement of Aggregation Degree]

The aggregation degree of each toner was measured in the following way by using a powder tester "PT-D" (a product of Hosokawa Micron K. K.).

(1) Each toner as the measurement object was left to stand for 12 hours in a measurement environment.

(2) A sieve of a three-layered structure having mesh sizes of 75 μm, 45 μm and 22 μm, from above, was placed on a vibration table.

(3) 2 g of the toner left standing in the step (1) was gently put on the sieve of the mesh size of 75 μm.

(4) The sieve was vibrated as a whole at amplitude of 1 mm for 30 seconds.

(5) The amount of the toner remaining on each sieve was measured as follows.

remaining toner amount (g) on 75 μm-sieve/2×100 (a)

remaining toner amount (g) on 45 μm-sieve/2×100×⅗ (b)

remaining toner amount (g) on 22 μm-sieve/2×100×⅕ (C)

The sum of these measurement values (a), (b) and (c) was used as the aggregation degree of the toner.

aggregation of toner (%)=(a)+(b)+(c)

[Measurement of Electrostatic Charge Amount]

To measure the electrostatic charge amount of the toner, the sample toner and a magnetite carrier were mixed in a toner concentration of 50 wt %. The mixture was stirred inside a vessel having a capacity of 50 ml for 10 minutes and measured by a magnet blow-off method. After the charge amount so measured was confirmed, the charge amount (q/m) in the toner layer on the developing roller was calculated from a toner layer potential $V_\tau$ and the toner layer thickness $d_\tau$ in accordance with the following formula (1) by using an actual apparatus (color image formation-apparatus of FIG. 1 equipped with the developing machine explained with reference to FIG. 2).

$$q/m=2\epsilon_o\epsilon_{r1}V_\tau/(\rho P d_\tau^2) \quad (1)$$

where $\epsilon_o$: dielectric constant of vacuum ($8.85\times10^{-12}$ F/m)

$\epsilon_{r1}$: specific dielectric constant of toner layer (2.2)

ρ: density of toner (1.1 g/cm$^3$)

P: packing ratio of toner layer (constant: assumed to be 0.45)

$V_\tau$: toner layer potential (variable)

$d_\tau$: toner layer thickness (variable)

The toner layer potential was measured by using a surface potentiometer "Model 344" (a product of Treck Co.). The toner layer thickness was measured by using a laser dimension meter "LS-5000" (a product of Kiense Co.). The difference of the values before and after the toner layer was sucked and removed was used as the actual measurement value. Incidentally, since the toner layer thickness condition changed between the condition immediately after printing and another condition, the toner layer thickness was measured after one full black printing and three full white printing were made so as to always attain a predetermined condition. The measurement points of the toner layer potential and the toner layer thickness were so set as to remain the same.

Table 1, below, represents the comparative result of the change ratio of the aggregation degree (initial aggregation degree/aggregation degree after no-load revolution of developing portion for 20 hours) and the change ratio of the electrostatic charge amount (initial charge amount/charge amount after no-load revolution of developing portion for 20 hours)

TABLE 1

| | change of aggregation degree | | | change of charge amount | | |
|---|---|---|---|---|---|---|
| toners | initial (%) | developing portion (%) after no-load revolution | change ratio 0.8–1.2 | initial (μc/g) | developing portion (μc/g) after no-load revolution | change ratio 1.0–1.5 |
| toner A | 42 | 43 | 0.98 | −20 | −12 | 1.67 |
| toner B | 40 | 42 | 0.95 | −20 | −11 | 1.82 |
| toner C | 20 | 40 | 0.50 | −24 | −12 | 2.00 |
| toner D | 30 | 36 | 0.83 | −25 | −19 | 1.32 |
| toner E | 45 | 42 | 1.07 | −35 | −32 | 1.09 |
| toner F | 66 | 57 | 1.16 | −41 | −35 | 1.17 |
| toner G | 32 | 40 | 0.80 | 15 | 11 | 1.36 |
| toner H | 50 | 44 | 1.14 | −36 | −31 | 1.16 |

As to the change ratio of the aggregation degree of the toner, the toner A (Comparative Example) that did not use the external additive exhibited the smallest change as will be understood from Table 1. However, the toner A had non-uniformity of the density from initial image quality and extremely low reproducibility of the intermediate tone, and invited problems with the smooth transportation inside the developing machine, charging, formation of the toner layer, and so forth. Therefore, this toner A could not be used practically. The toner C (Comparative Example) to which 0.5 wt % of silica having a small particle size was added had a high change ratio, and the change of image quality was high due to this change ratio. Therefore, this toner C was not suitable. In contrast, all the toners D to H (Examples of the present invention), to which 1.5 to 10.0 parts by weight of the total amount of the external additives were added, had a small change ratio and provided an excellent image formation condition. The change ratio is preferably within the range of 0.8 to 1.2 and further preferably, around 1.0.

As to the change ratio of the electrostatic charge amount of the toner, better results could be obtained in the toners E, F and H to which fine particles having an opposite charge were added. As will be understood from the Table 1, the fine particles having an opposite charge, that is, the fine particles having an opposite polarity, preferably have a particle diameter within the range of 0.3 to 1.5 μm. When the particle diameter is smaller than 0.3 μm, the charge amount of the toner on the sleeve is dropped and when the particle diameter is greater than 1.5 μm, on the contrary, the effect of stabilizing the charge amount cannot be obtained. Though the reason is not clear, it is assumed that the opposite polarity fine particles of a sub-micron size are likely to separate from the toner and adhere to the toner support with the result that the charging series of the toner on the frictional member shifted to the positive polarity side and eventually, the drop of the charge amount of the toner can be prevented. The change ratio is preferably within the range of 1.0 to 1.5 and further preferably, within the range of 1.0 to 1.2.

Further, according to method of the present invention, if the total amount of the external additives to be added to the toner is controlled to an excessive level of 1.5 to 10.0 wt %, it becomes possible to inhibit the change ratio of the aggregation degree to a low level. The addition of the external additive having opposite chargeability can also inhibit the change ratio of the charge amount to a low level.

As explained above, since the present invention sets the total of the external additives to be added to the non-added toner to 1.5 to 10.0 parts by weight based on 100 parts by weight of the non-added toner so that the aggregation degree of the toner is 30 to 80% in the one-component developing method, and mixes the particles having particle diameters of 30 to 100 nm with particles having smaller particle diameters as the external additives, the present invention can limit the change ratio, between the initial stage and the end of the usable life, of the aggregation degree of the toner to 0.8 to 1.2, and can form a high-quality image having an extremely small change of image quality with time.

Further, the total amount of the external additives, added to the non-added toner so that the aggregation degree of the toner becomes 30 to 80% in the one-component developing method, is 1.5 to 10.0 parts by weight based on 100 parts by weight of the non-added toner. The external additives used in the present invention comprise particles having ordinary particle diameters and particles smaller than the former, and use at least two kinds of external additives. Since, the charge amount of at least one of them is different from other charge polarity so that the change ratio of the toner charge amount from the initial stage to the end of the usable life is kept within the range of 1.0 to 1.5, a high-quality image having an extremely small change of image quality with time can be obtained.

What is claimed is:

1. A method for the formation of a color image which comprises the steps of forming an electrostatic latent image in accordance with an electrophotographic process, visualizing said electrostatic latent image by a developer transported by a developer support to form a multicolored toner image whereby monochromatic color toner images are formed by mutually independent developing steps comprising a contact type non-magnetic one-component developing method, and superposing then the resulting monochromatic toner images with one another to form a multicolored toner image, and in which method a toner used in each developing step contains an external additive which comprises inorganic fine particles having a mean particle diameter of 30 to 100 nm, said inorganic fine particles comprising particles of hydrophobic silica having a negative charge polarity, and fine particles having a positive charge polarity and a diameter within the range of 0.3 to 1.5 $\mu$m, the addition amount of the external additive to a non-added toner containing no external additive is within the range of 1.5 to 10.0 parts by weight on the basis of 100 parts by weight of said non-added toner, and the aggregation degree of said toner is within the range of 30 to 80%, and the change ratio of the aggregation degree satisfies the following formula:

$$1.0 \leqq (\text{initial aggregation degree})/(\text{aggregation degree after 20 hours of no-load revolution of developing roller used as the developer support}) \leqq 1.2; \text{ and}$$

wherein said developer is a nonmagnetic one-component developer.

2. A color image formation method according to claim 1 wherein a mixture of first silica particles having a mean particle diameter of 30 to 100 nm and second silica particles having a mean particle diameter smaller than that of the first silica particles is used as said inorganic fine particles.

3. A color image formation method according to claim 1, wherein said inorganic fine particle have a primary particle diameter of 0.005 to 2 mm and the specific surface area, measured by the BET method, of 20 to 500 $m^2/g$.

4. A color image formation method according to claim 1, wherein said fine particles having a positive charge polarity are fine particles selected from the group consisting of polystyrene, copolymers of methacrylic acid ester and acrylic acid ester, polycondensates of silicone and benzoguanamine, nylon and thermosetting resins.

5. A color image formation method according to claim 1, in which monochromatic toner image of yellow, magenta, cyan and black each is formed by the following steps:

(1) charging step for imparting photosensitivity to an image support as an electrostatic recording medium;

(2) exposing step of applying image formation exposure to the image support, and forming and recording an electrostatic latent image;

(3) developing step of causing the electrostatic latent image recorded on the image support to electrically attract a developer, and physically visualizing the electrostatic latent image;

(4) transferring step of serially transferring the visualized toner image on the image support to the recording medium, and superposing the visualized toner images with one another; and (5) image fixing step of heating and fixing the transferred image on the recording medium.

6. A method for the formation of a color image which comprises the steps of forming an electrostatic latent image in accordance with an electrophotographic process, visualizing said electrostatic latent image by a developer transported by a developer support to form a multicolored toner image whereby monochromatic color toner images are formed by mutually independent developing steps comprising a contact type non-magnetic one-component developing method, and then superposing the resulting monochromatic toner images with one another to form a multicolored toner image, and in which method a toner used in each developing step contains an external additive which comprises inorganic fine particles having a mean particle diameter of 30 to 100 nm, said inorganic fine particles comprising particles of hydrophobic silica having a negative charge polarity, and fine particles having a positive charge polarity and a diameter within the range of 0.3 to 1.5 $\mu$m, the addition amount of the external additive to a non-added toner containing no external additive is within the range of 1.5 to 10.0 parts by weight on the basis of 100 parts by weight of said non-added toner, and the change ratio of the electrostatic charge amount of said toner on an image support for forming and visualizing said electrostatic latent image satisfies the following formula:

$$1.0 \leqq (\text{initial charge amount})/(\text{charge amount after 20 hours of no-load revolution of developing roller used as the developer support}) \leqq 1.2; \text{ and}$$

wherein said developer is a nonmagnetic one-component developer.

7. A color image formation method according to claim 6, wherein a mixture of first silica particles having a mean particle diameter of 30 to 100 nm and second silica particles having a mean particle diameter smaller than that of the first silica particles is used as said inorganic fine particles.

8. A color image formation method according to claim 6, wherein said inorganic fine particles have a primary particle diameter of 0.005 to 2 mm and the specific surface area, measured by the BET method, of 20 to 500 $m^2/g$.

9. A color image formation method according to claim 6, wherein said fine particles are fine particles selected from the group consisting of polystyrene, copolymers of methacrylic acid ester and acrylic acid ester, polycondensates of silicone and benzoguanamine, nylon and thermosetting resins.

10. A color image formation method according to claim 6, in which monochromatic toner image of yellow, magenta, cyan and black each is formed by the following steps:

(1) charging step for imparting photosensitivity to an image support as an electrostatic recording medium;

(2) exposing step of applying image formation exposure to the image support, and forming and recording an electrostatic latent image;

(3) developing step of causing the electrostatic latent image recorded on the image support to electrically attract a developer, and physically visualizing the electrostatic latent image;

(4) transferring step of serially transferring the visualized toner image on the image support to the recording medium, and superposing the visualized toner images with one another; and (5) image fixing step of heating and fixing the transferred image on the recording medium.

* * * * *